US005565970A

United States Patent [19]

Suda

[11] Patent Number: 5,565,970

[45] Date of Patent: Oct. 15, 1996

[54] IMAGE FORMING APPARATUS

[75] Inventor: Masashi Suda, Iruma, Japan

[73] Assignee: Canon Kabushiki Kaisha, Tokyo, Japan

[21] Appl. No.: 429,025

[22] Filed: Apr. 26, 1995

Related U.S. Application Data

[63] Continuation of Ser. No. 70,845, Jun. 3, 1993, abandoned.

[30] Foreign Application Priority Data

Jun. 5, 1992 [JP] Japan ..... 4-171589
Apr. 27, 1993 [JP] Japan ..... 5-101041

[51] Int. Cl.[6] ..... G03G 15/00; G03G 21/00

[52] U.S. Cl. ..... 355/308; 271/9.01

[58] Field of Search ..... 355/308, 309, 355/311; 271/9.01

[56] References Cited

U.S. PATENT DOCUMENTS

| | | | |
|---|---|---|---|
| 3,920,238 | 11/1975 | Kitajima et al. | 271/9 |
| 3,963,339 | 6/1976 | Taylor et al. | 355/309 X |
| 4,366,219 | 12/1982 | Beery | 355/311 X |
| 4,484,737 | 11/1984 | Sugiyama | 355/309 X |
| 4,538,799 | 9/1985 | Bhagwat | 271/9 |
| 4,985,736 | 1/1991 | Kawano et al. | 355/311 |
| 5,086,318 | 2/1992 | Takeda et al. | 355/308 X |
| 5,091,751 | 2/1992 | Inoue et al. | 355/309 X |
| 5,168,290 | 12/1992 | Tanaka et al. | 355/309 X |
| 5,319,433 | 6/1994 | Fukushima et al. | 355/326 R |

FOREIGN PATENT DOCUMENTS

| | | |
|---|---|---|
| 219244 | 4/1987 | European Pat. Off. . |
| 398659 | 11/1990 | European Pat. Off. . |
| 2651217 | 8/1990 | France . |
| 61-29860 | 2/1986 | Japan . |
| 1-120575 | 5/1989 | Japan . |

*Primary Examiner*—Fred L. Braun
*Attorney, Agent, or Firm*—Fitzpatrick, Cella, Harper & Scinto

[57] ABSTRACT

The present invention provides an image forming apparatus with a first accommodating cassette for accommodating sheets, a second accommodating cassette arranged above the first accommodating cassette and adapted to accommodate sheets, an image forming device arranged above the second accommodating cassette and adapted to form an image on the sheet, a first sheet guide path for feeding the sheet from a first end of the first accommodating cassette to an image forming station, and a second sheet guide path for feeding the sheet from a second end of the second accommodating cassette and joined to the first sheet path. A curl correction device causes sheets from different cassettes to bend in the same direction.

29 Claims, 6 Drawing Sheets

IMAGE FORMING APPARATUS

This application is a continuation of application Ser. No. 08/070,845, filed Jun. 3, 1993, now abandoned.

BACKGROUND OF THE INVENTION

1. Field of the Invention

The present invention relates an image forming apparatus such as a copying machine, printer, facsimile machine and the like.

2. Related Background Art

In image forming apparatuses such as copying machines, printers, facsimile machine and the like, it is known to arrange a plurality of sheet supply cassettes within the apparatus in an up-and-down direction so that sheet s in the cassettes can selectively be supplied to an image forming station. In such an image forming apparatus, since the plurality of sheet supply cassettes (of front loading type which can be mounted to and dismounted from the apparatus from a front side of the apparatus) containing the sheets having different sizes are arranged within the apparatus, it is possible to reduce the time required for exchanging the sheets. Further, since the plurality of cassettes are arranged within the apparatus in the up-and-down direction, it is possible to reduce the installation space for the image forming apparatus.

In FIG. 6 showing an example of a conventional color image forming apparatus (copying machine) of the above type, a photosensitive drum 2, a transfer drum 3 and the like are arranged within the copying machine 1 at an upper part thereof, and a plurality of sheet supply cassettes 5, 6, 7 and 9 containing sheets having different sizes are arranged within the copying machine 1 at a lower part thereof.

The photosensitive drum 2 is rotated in a clockwise direction. Around the photosensitive drum 2, there are arranged a primary charger 10 for uniformly charging the rotating photosensitive drum 2; a magenta developing device 11, a cyan developing device 12, a yellow developing device 13 and a black developing device 15, which developing devices serve to develop an electrostatic latent image formed on the photosensitive drum 2; a cleaning blade 16 for scraping the residual toner remaining on the photosensitive drum 2; a collection roller 17 for collecting the toner scraped by the cleaning blade 16; and a potential sensor 19 for detecting a biasing condition of the photosensitive drum 2 to control the bias applied to the primary charger 10 and the developing devices 11, 12, 13 and 15.

An original 21 rested on a glass platen 20 of the copying machine 1 is illuminated by a illuminating lamp 22 from the below. An illuminated image on the original is incident to a lens 27 via reflection mirrors 23, 25 and 26 which are shifted at predetermined speeds, thereby focusing an light image on a taking element 29. The light image is photoelectrically converted into a signal by the taking element 29, which signal is in turn inputted to a laser scanner 31 through an image processing portion 30. Laser light L emitted from the laser scanner 31 is sent to an image writing position a on the photosensitive drum 2 via a reflection mirror 32.

In this way, the image of the original 21 is successively written on the photosensitive drum 2 which has been uniformly charged by the primary charger 10 and which is being rotated in the clockwise direction, thereby forming the electrostatic latent image on the photosensitive drum. Then, the electrostatic latent image is visualized by color toners in the developing devices 11, 12, 13 and 15.

The transfer drum 3 comprises a cylindrically shaped plastic film and is rotated in an anti-clockwise direction. Around the transfer drum 3, at predetermined positions, there are arranged an adsorption charger brush 33 and an adsorption roller 35, which serve to adhere the sheet fed from the sheet supply cassette 5, 6, 7 or 9 to the transfer drum 3; a transfer brush 36 for bias-transferring the toner image on the photosensitive drum 2 onto the sheet adhered to the transfer drum 3; a charge removing device 37 for removing the charge from the surface of the sheet, and a separating pawl or claw 39 for separating the sheet from the transfer drum 3.

The sheet supplied from the sheet supply cassette 5, 6, 7 or 9 is sent between the transfer drum 3 rotated in the anti-clockwise direction and the adsorption roller 35 and is adhered to the transfer drum 3 by the adsorption charger brush 33 and the adsorption roller 35. Then, the toner image on the photosensitive drum 2 is bias-transferred onto the sheet adhered to the transfer drum 3 color by color by the transfer brush (image forming portion) 36.

The charge on the sheet on which the toner image was transferred is removed by the charge removing device 37, and then, the sheet is separated from the transfer drum 3 by the separating pawl 39. The separated sheet is fed to a nip between a pair of fixing rollers 41 while being attracted by a convey belt 40. The toner image is permanently fixed to the sheet with heat and pressure by the paired fixing rollers 41. Thereafter, the sheet is discharged onto a sheet discharge tray (not shown) out of the copying machine by a pair of sheet discharge rollers 42.

After the transferring operation, the residual toner remaining on the photosensitive drum 2 is scraped by the cleaning blade 16 and then is collected by the collection roller 17.

The sheet supply cassettes 5, 6, 7 and 9 are of the type capable containing the maximum size sheets and are vertically spaced apart from each other by a predetermined distance. In this case, sheet supply ends 5A, 6A, 7A and 9A of the sheet supply cassettes 5, 6, 7 and 9 are disposed at the same side (right side in FIG. 6). The sheet supply cassettes 5, 6, 7 and 9 can be inserted into and retracted from the copying machine 1 from the front side thereof in a direction perpendicular to the plane of FIG. 6 by guiding left and right guides 45A, 45B of the cassettes along left and right rails 43A, 43B of the copying machine.

The sheets contained in each sheet supply cassette 5, 6, 7 and 9 are fed out by sheet supply rollers (pick-up rollers) 46, 47, 49 and 50 rotated in an anti-clockwise direction and are sent between the transfer roller 3 and the adsorption roller 35 through sheet path 51, 52, 53 and 55 and a common sheet path 56. Incidentally, the sheet fed out from each cassette 5, 6, 7 and 9 is fed to a corresponding pair of regist rollers 57, 59, 60 and 61 where the skew-feed of the sheet is corrected. Then, each sheet is sent to a second pair of regist rollers 65 by the respective paired regist rollers 57, 59, 60 and 61 and paired feed rollers 62, 63, which are rotated at a predetermined timing, thereby finally correcting the skew-feed of the sheet. Then, the sheet is sent between the transfer roller 3 and the adsorption roller 35 by the second pair of regist rollers 65 which are rotated at a predetermined timing.

The sheet fed by the paired regist rollers 65 is adhered to the transfer drum 3 by the action of the adsorption charger brush 33 and the adsorption roller 35. The transfer drum 3 is rotated in such a manner that the peripheral speed of the transfer drum becomes the same as a feeding speed of the sheet. Further, the transfer drum 3 is rotated so that the sheet adhered to the transfer drum passes through a transfer station C repeatedly.

On the other hand, the photosensitive drum (image bearing member). 2 is rotated so that the magenta color toner image developed by the magenta developing device 11 is firstly transferred onto the sheet adhered to the transfer drum 3 at the transfer station C. Then, the cyan color toner image is formed on the photosensitive drum 2 by the cyan developing device 12. During the second sheet pass, the cyan color toner image is transferred onto the same sheet adhered to the transfer drum 3 at the transfer station C. Similarly, during the third sheet pass the yellow color toner image is transferred onto the same sheet, and during the fourth sheet pass the black color toner image is transferred onto the same sheet. By transferring the four color toner images to the same single sheet in a superimposed fashion, a full-color image can be obtained.

By the way, in this conventional color image forming apparatus, since the photosensitive drum 2 and the transfer drum 3 each having a large diameter are arranged within the image forming apparatus, the installation space for the plurality of the sheet supply cassettes 5, 6, 7 and 9 are greatly limited in comparison with normal mono-color image forming apparatuses. Accordingly, conventionally, when a number of sheet supply cassettes 5, 6, 7 and 9 are arranged in the limited space within the image forming apparatus as much as possible, the sheet supply roller 46 for the uppermost sheet supply cassette 5 was made small-sized or the curvature of the sheet path 51 was minimized, because the installation space for the sheet supply roller 46 and the space for forming the sheet path 51 were limited by the presence of the common sheet path 56.

By the way, the transfer drum 3 used with the color image forming apparatus must have the ability of winding the maximum size sheet; for example, when a sheet having the maximum sheet length size of 420 mm is used, a transfer drum 3 having a diameter of 160 mm is required. Further, in order to prevent the deviation of the image, the photosensitive drum 2 must have the same diameter as that of the transfer drum 3.

However, in the above-mentioned conventional color image forming apparatus, since the sheet supply roller 46 having the small diameter was used in association with the uppermost sheet supply cassette and the curvature of the sheet path 51 was reduced, when thick sheets having the greater friction or films having the greater resiliency are supplied from the uppermost sheet supply cassette, it was feared that the poor sheet supply or the sheet jam occurred. Thus, in the conventional color image forming apparatus, in order to supply the thick sheet and the film, a manual sheet supply portion (not shown) having a straight sheet path must be provided for compensating for the case where the sheet supply cassettes 6, 7 and 9 other than the uppermost one cannot be used for the thick sheet or film.

This problem occurs in not only the color image forming apparatus but also, for example, in a mono-color image forming apparatus wherein the number of sheet supply cassettes is desired to increase in a limited space within the apparatus.

SUMMARY OF THE INVENTION

The present invention intends to eliminate the above-mentioned conventional drawbacks, and has an object to provide an image forming apparatus which can supply thick sheets having great friction or films having great resiliency from an uppermost sheet supply cassette without the poor sheet supply and the sheet jam even when a number of sheet supply cassettes are arranged in a limited space within the image forming apparatus as much as possible.

To achieve the above object, there is provided an image forming apparatus wherein a plurality of sheet supply cassettes are arranged in an up-and-down direction within the apparatus and sheets in the sheet supply cassettes are selectively supplied to an image forming station, comprising first accommodating means for accommodating sheets, second accommodating means arranged above the first accommodating means to accommodate sheets, image forming means arranged above the second accommodating means to form an image on the sheet, a first sheet path for feeding the sheet from a first end of the first accommodating means to the image forming station, and a second sheet path for feeding the sheet from a second end of the second accommodating means and joined to the first sheet path, which second end is positioned at the same side as the first end of the first accommodating means. Wherein a junction between the first and second sheet paths is positioned above the first and second ends and between the first and second ends.

DETAILED DESCRIPTION OF THE PREFERRED EMBODIMENTS

Figure 1:
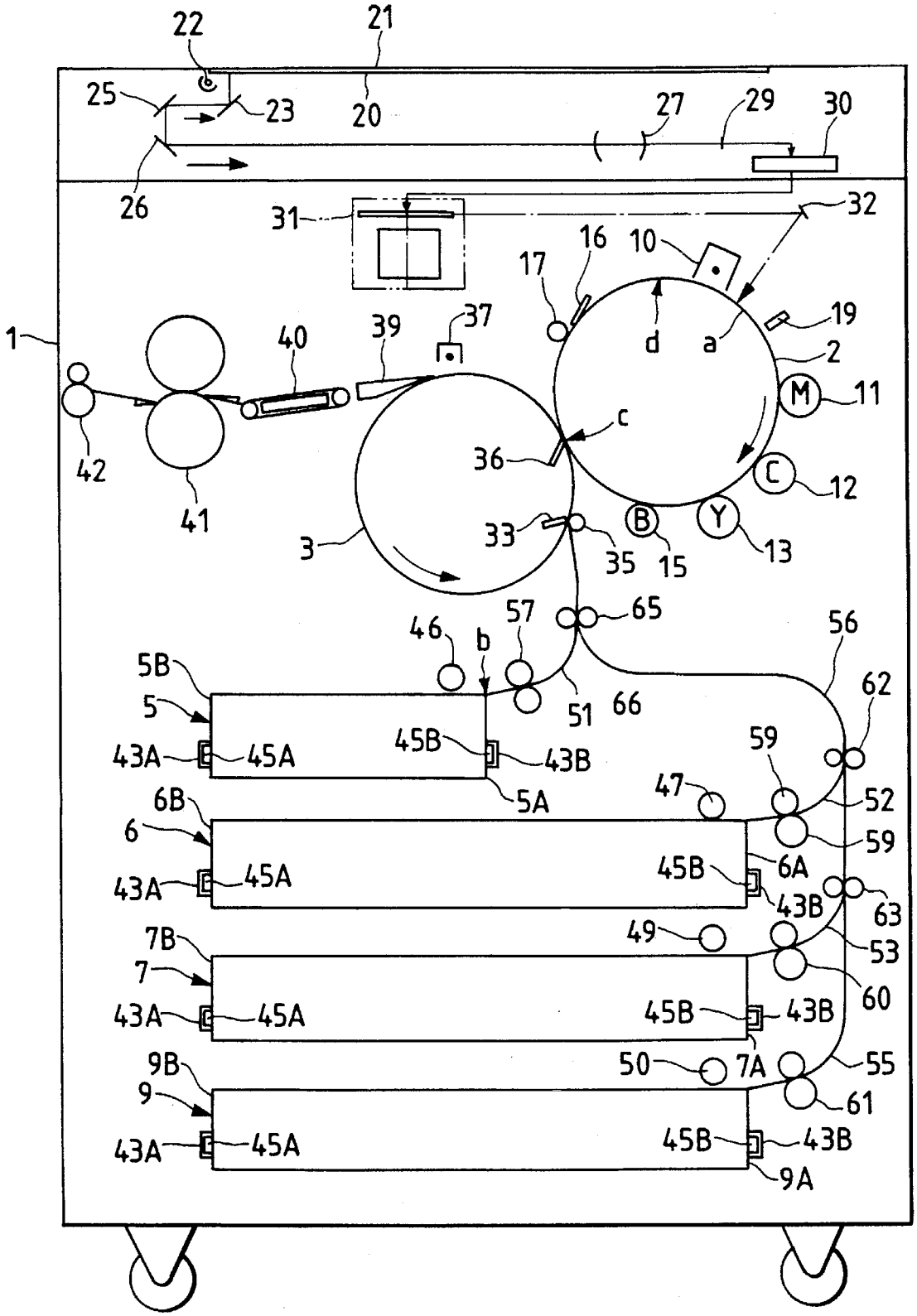
FIG. 1 is a longitudinal sectional view of a color image forming apparatus (copying machine) according to a first embodiment of the present invention.

The present invention will now be explained in connection with embodiments thereof with reference to the accompanying drawings. Incidentally, in an image forming apparatus according to the present invention, the same constructural and functional elements as those of the aforementioned conventional color image forming apparatus are designated by the same reference numerals and the detailed explanation thereof will be omitted.

FIG. 1 shows a whole construction of a color image forming apparatus (copying machine) according to a first embodiment of the present invention.

In this color image forming apparatus, second, third and fourth sheet supply cassettes 6, 7 and 9 are of the type capable of stacking and containing the maximum size sheets (normal sheet supply cassettes), and a first or uppermost sheet supply cassette 5 is of the type capable of stacking and containing sheets having a half of the maximum size or less (small-sized cassette). The first cassette 5 is disposed so that a supply end of the first sheet supply cassette is offset inwardly from supply ends 6A, 7A and 9A of the second, third and fourth sheet supply cassettes 6, 7 and 9 and the other end 5B of the first sheet supply cassette 5 is vertically aligned with the other ends 6B, 7B and 9B of the second, third and fourth sheet supply cassettes 6, 7 and 9.

Further, a sheet path 51 for the sheet supplied from the first sheet supply cassette 5 is joined to a common sheet path 56 for the sheets supplied from the second, third and fourth sheet supply cassettes 6, 7 and 9 between the supply end 5A of the first sheet supply cassette 5 and the supply end 6A of the second sheet supply cassette 6. A second pair of regist rollers 65 are arranged at the junction 66 between the sheet paths 51, 56. The junction 66 between the sheet path 51 and the common sheet path 56 is disposed below a photosensitive drum 2 for performing the image forming operation and a transfer drum 3.

With this arrangement, the space for forming the sheet path 51 for the first sheet supply cassette 5 is not limited by the presence of the common sheet path 56 for the second, third and fourth sheet supply cassettes 6, 7 and 9, and, accordingly, it is possible to increase the curvature of the sheet path 51. Further, the installation space for the sheet supply roller 46 for the first sheet supply cassette 5 is not limited by the presence of the common sheet path 56 for the second, third and fourth sheet supply cassettes 6, 7 and 9, and, accordingly, it is possible to use the sheet supply roller 46 having the large diameter.

In this color image forming apparatus, since a distance bc between a leading end b of the sheet in the first sheet supply cassette 5 and the transfer position c (including the regist feeding amount) can be made smaller than a distance dc between a tip end position d of the image on the photosensitive drum 2 and the transfer position c (dc>bc), even when the sheet in the first sheet supply cassette 5 is supplied at a speed same as the peripheral speed of the photosensitive drum 2 after the photosensitive drum starts to rotate, the sheet can reach the transfer position c. Accordingly, the copying time for the sheet supplied from the first sheet supply cassette 5 can be reduced, and the sequence can be simplified.

Incidentally, even when the sheet supply cassette of the type capable of stacking and containing sheets having a half of the maximum size or less is used as the first sheet supply cassette 5 as in this color image forming apparatus, for example, since the sheet mainly used in an image forming apparatus using sheets having the maximum size A3 is A4 size and the maximum size sheets can be supplied from the second, third or fourth sheet supply cassette 6, 7 and 9, there is no problem regarding the supplying of the maximum size sheet. Therefore, when the number of the sheet supply cassettes is great and there is enough margin for the supplying of the maximum size sheet, the second sheet supply cassette 6 can be constructed as same as the first sheet supply cassette 5.

Next, a second embodiment of the present invention will be explained.

Figure 2:
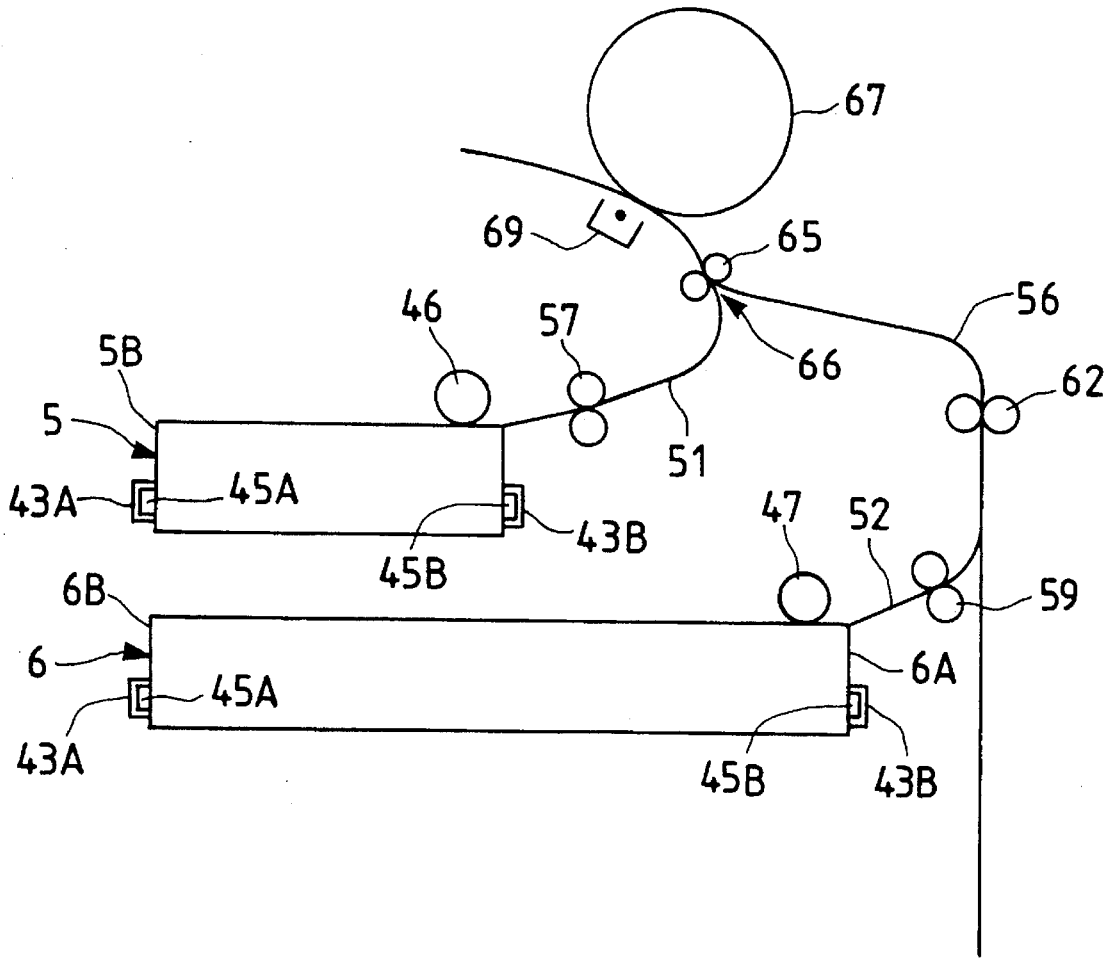
FIG. 2 is a longitudinal sectional view of a main portion of a color image forming apparatus (copying machine) according to a second embodiment of the present invention.

In a second embodiment shown in FIG. 2, an example that the sheet supply cassettes 5, 6, 7 and 9 (sheet supply cassettes 7, 9 are omitted from illustration) are used in a normal mono-color image forming apparatus (copying machine) is shown. In this case, the sheet supplied from the first, second, third or fourth sheet supply cassette 5, 6, 7 or 9 is sent between a photosensitive drum 67 and a transfer charger 69 by the second pair of regist rollers 65.

As mentioned above, in the above-mentioned embodiments, since the small-sized sheet supply cassette (not containing the maximum size sheets) is used as the uppermost sheet supply cassette so that the sheet supply roller and the sheet path for the uppermost sheet supply cassette are disposed at the positions which are not influenced by the presence of the common sheet path for the other sheet supply cassettes capable of containing the maximum size sheets, it is possible to use the sheet supply roller having the greater diameter can be used in association with the uppermost sheet supply cassette and to increase the curvature of the sheet path for the uppermost sheet supply cassette. Therefore, even when a number of sheet supply cassettes are arranged in the limited space within the image forming apparatus as much as possible, it is possible to stably supply the thick sheets having the great friction and the films having the great resiliency from the uppermost sheet supply cassette.

Figure 3:
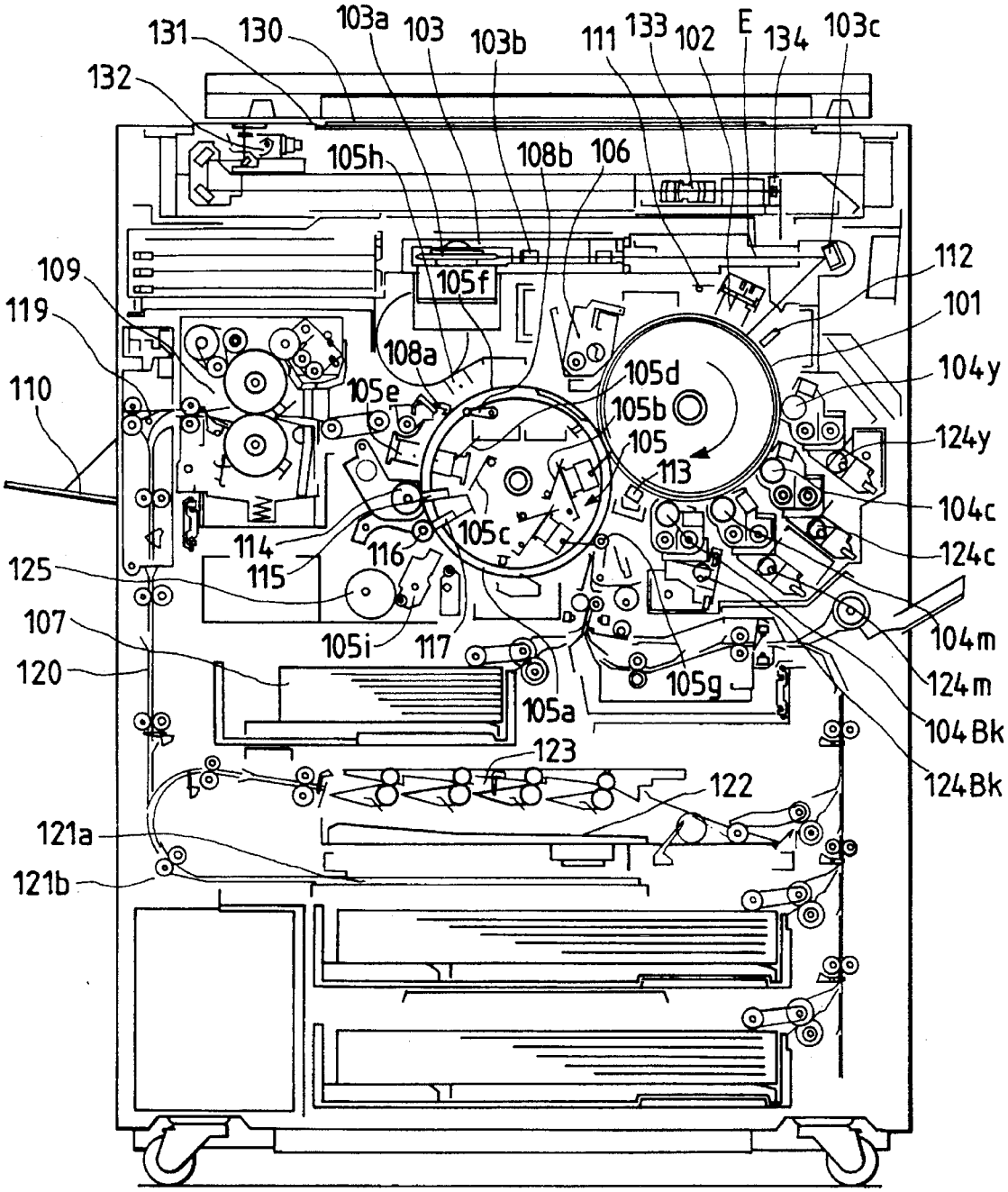
FIG. 3 is a longitudinal sectional view of a color image forming apparatus (copying machine) according to a third embodiment of the present invention.

Next, a color image forming apparatus according to a third embodiment of the present invention will be explained with reference to FIG. 3. This image forming apparatus includes a digital color image reader portion at its upper part, and a digital color image printer portion at its lower part.

In the reader portion, an original 130 is rested on an original support glass 131. By exposure-scanning the original by an exposure lamp 132, a light image reflected from the original 130 is focused on a full-color sensor 134 by a lens 133, thereby obtaining a color decomposing image signal. This color decomposing signal is sent, via an amplifier circuit (not shown), to a video processing unit (not shown), where the signal is processed. The processed signal is sent to the printer portion.

In the printer portion, a photosensitive drum (image bearing member) 101 is supported for rotation in a direction shown by the arrow. Around the photosensitive drum 101, there are arranged a pre-exposure lamp 111, a corona charger 102, a laser exposure optical system 103, a potential sensor 112, four different color developing devices 104*y*, 104*c*, 104*m* and 104Bk, a light amount detection means 113 for detecting a light amount on the photosensitive drum, a transfer device 105, and a cleaning device 106. In the laser exposure optical system 103, the image signal from the reader portion is converted into a light image by a laser output portion (not shown), and the converted laser light is reflected by a polygon mirror 103*a* to be projected onto the surface of the photosensitive drum 101 through a lens 103*b* and a mirror 103*c*.

During the image forming operation in the printer portion, the photosensitive drum 101 is rotated in the direction shown by the arrow. After the charge on the photosensitive drum is removed by the pre-exposure lamp 111, the photosensitive drum 101 is uniformly charged by the charger 102 and the light image E of each decomposed color is illuminated on the photosensitive drum, thereby forming a latent image.

Then, the latent image on the photosensitive drum 101 is developed by the corresponding developing device, thereby forming a toner image (based on resin) on the photosensitive drum 101. The developing devices can be selectively approached to the photosensitive drum 101 by corresponding eccentric cams 124*y*, 124*c*, 124*m* and 124Bk in response to the decomposed color component.

Further, the toner image on the photosensitive drum 101 is transferred onto a recording sheet supplied from a sheet supply cassette 107 to a position confronting to the photosensitive drum 101 by a convey means, by the transfer device 105. In the illustrated embodiment, the transfer device 105 comprises a transfer drum 105*a*, a transfer charger 105*b*, an adsorption charger 105*c* and an adsorption roller 105*g* which are opposed to each other and serve to electrostatically attract the recording sheet, an inner charger 105*d*, and an outer charger 105*e*. A recording sheet bearing film 105*f* made of dielectric material is integrally attached to the transfer drum 105*a* (rotatably supported) to cover an opening portion of the transfer drum. The recording sheet bearing film 105*f* may be made from a dielectric sheet such as a polycarbonate film. By rotating the transfer drum 105*a*, the toner image on the photosensitive drum 101 is transferred onto the recording sheet carried by the recording sheet bearing sheet 105*f* by the transfer charger 105*b*.

In this way, the desired number of color toner images are transferred to the recording sheet carried by the recording sheet bearing sheet 105*f*, thereby forming a full-color image.

In the full-color image forming apparatus, after the four color toner images were transferred to the recording sheet, the recording sheet is separated from the transfer drum 105*a* by a separating pawl 108*a*, a separation and pusher roller 108*b*, and a separation charger 105*h*. The separated sheet is sent to a heat roller fixing device 109 where the image is fixed to the sheet, and then the sheet is discharged onto a tray 110.

On the other hand, after the transferring operation, the residual toner remaining on the photosensitive drum 101 is removed by the cleaning device 106 to prepare the drum for the next image formation.

When images are to be formed on both surfaces of the recording sheet, after the recording sheet is discharged from the fixing device 109, the sheet is temporarily introduced into a reversing path 121*a* through a sheet path switching guide 119 and a vertical sheet path 120. Thereafter, by rotating a reversing roller 121*b* reversely, the sheet is fed back in the reverse direction onto an intermediate tray 122. Then, an image is formed on the other surface of the sheet by the above-mentioned image forming operation.

Further, in order to prevent the scattering and adhesion of toner onto the recording sheet bearing film 105*f* and the adhesion of oil to the recording sheet, the recording sheet bearing sheet is cleaned by a fur brush 114 and a back-up brush 115 confronting to the fur brush with the interposition of the recording sheet bearing sheet 105*f*, and an oil removing roller 116 and a back-up brush 117 confronting to the oil removing roller with the interposition of the recording sheet bearing sheet 105*f*. Such cleaning is effected after or before the image formation, and is always effected when the sheet jam occurs.

Further, in the illustrated embodiment, an eccentric cam 125 is actuated at a desired timing to drive a cam follower 105*i* integral with the transfer drum 105*a*, thereby permitting the setting of any gap between the recording sheet bearing sheet 105*f* and the photosensitive drum 101. For example, in a stand-by condition or a power-off condition, the transfer drum is spaced apart from the photosensitive drum.

Figure 4:
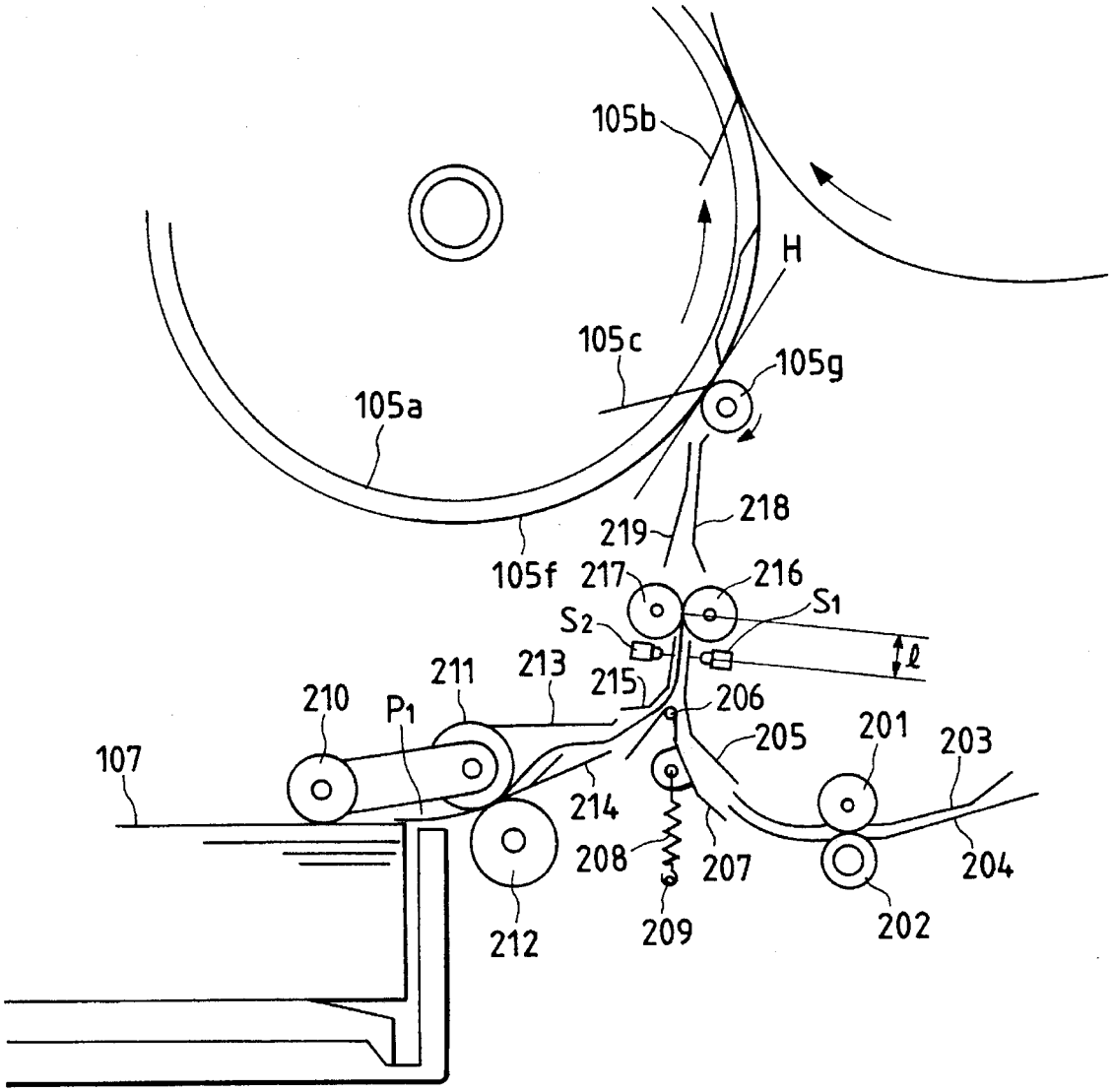
FIGS. 4 and 5 are sectional views for explaining an operation of the image forming apparatus of FIG. 3.

Now, the junction between the sheet path will be explained with reference to FIG. 4.

The sheet $P_1$ is supplied by a pick-up roller 210 and is fed by a feed roller 211 and a retard roller 212 to advance between upper and lower guides 213, 214 and between an upper guide 215 and a movable guide 207 and between the upper guide 215 and a right guide 205 to reach a pair of register rollers 216, 217 now stopped. Further, the sheet is further fed by about 5 mm by the rollers 211, 212 to form a loop having upward convex in the sheet $P_1$ as shown, and then the rollers are stopped. An amount of the loop is determined by feeding the sheet by a predetermined amount (i.e., 5 mm) after a leading end of the sheet is detected by sensors $S_1$, $S_2$. Then, in synchronous with a predetermined position of the recording sheet bearing sheet 105*f* of the transfer drum 105*a*, the pair of regist rollers 216, 217 are rotated, thereby feeding the sheet between left and right guides 219, 218 to introduce the sheet between the adsorption roller 105*g* and the adsorption charger 105*c* from slightly outward direction along the tangential line H between the transfer drum 105*a* and the adsorption roller 105*g*. In this way, the sheet is electrostatically adhered to the recording sheet bearing film 105*f*. Incidentally, as well as the electrostatic adhesion, the sheet may be mechanically gripped by a gripper and the like. Then, the toner image on the photosensitive drum 101 is transferred onto the sheet $P_1$ by the transfer charger 105*b* disposed immediately above the adsorption roller 105*g*.

Figure 5:
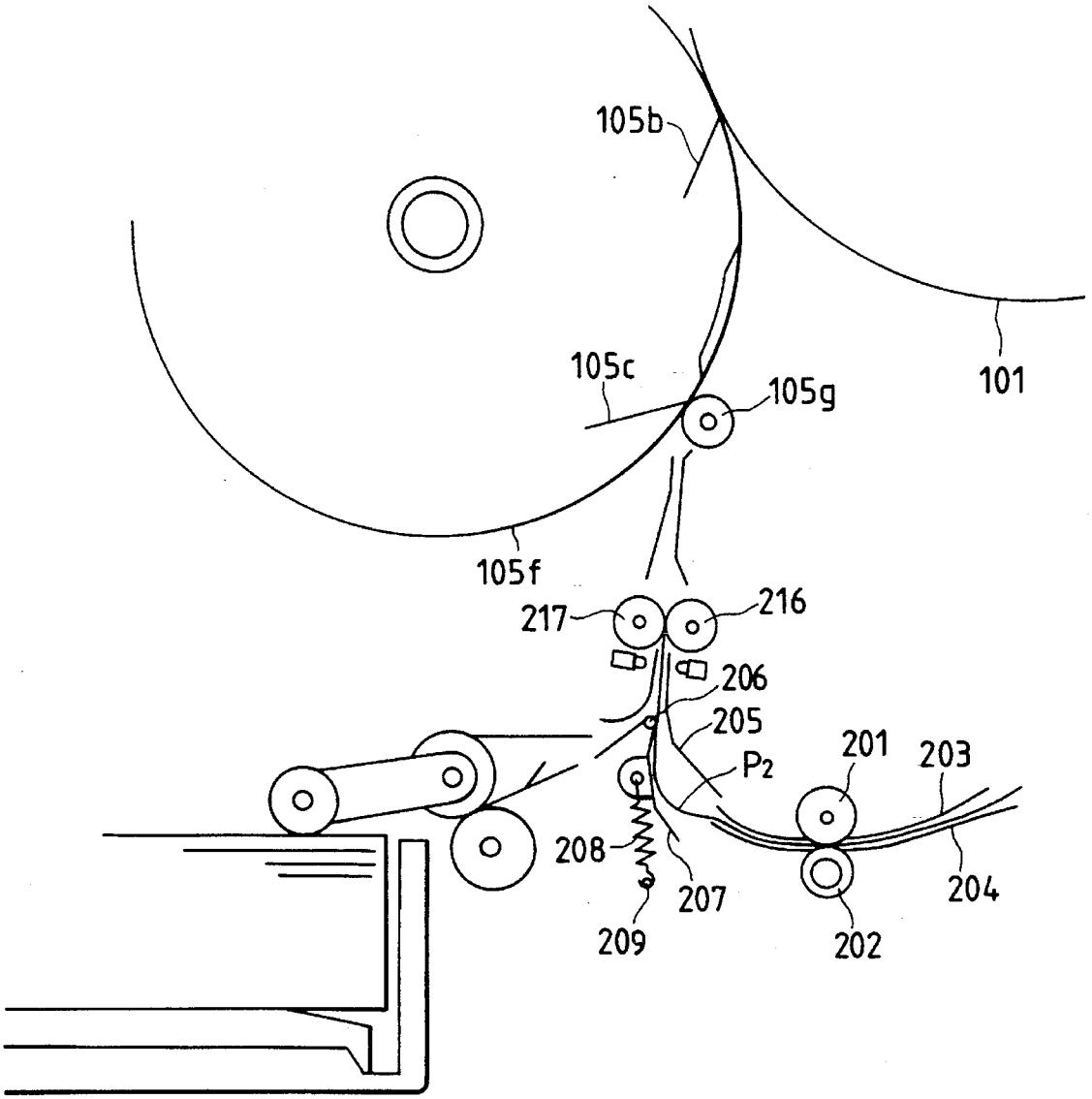
Figure 6:
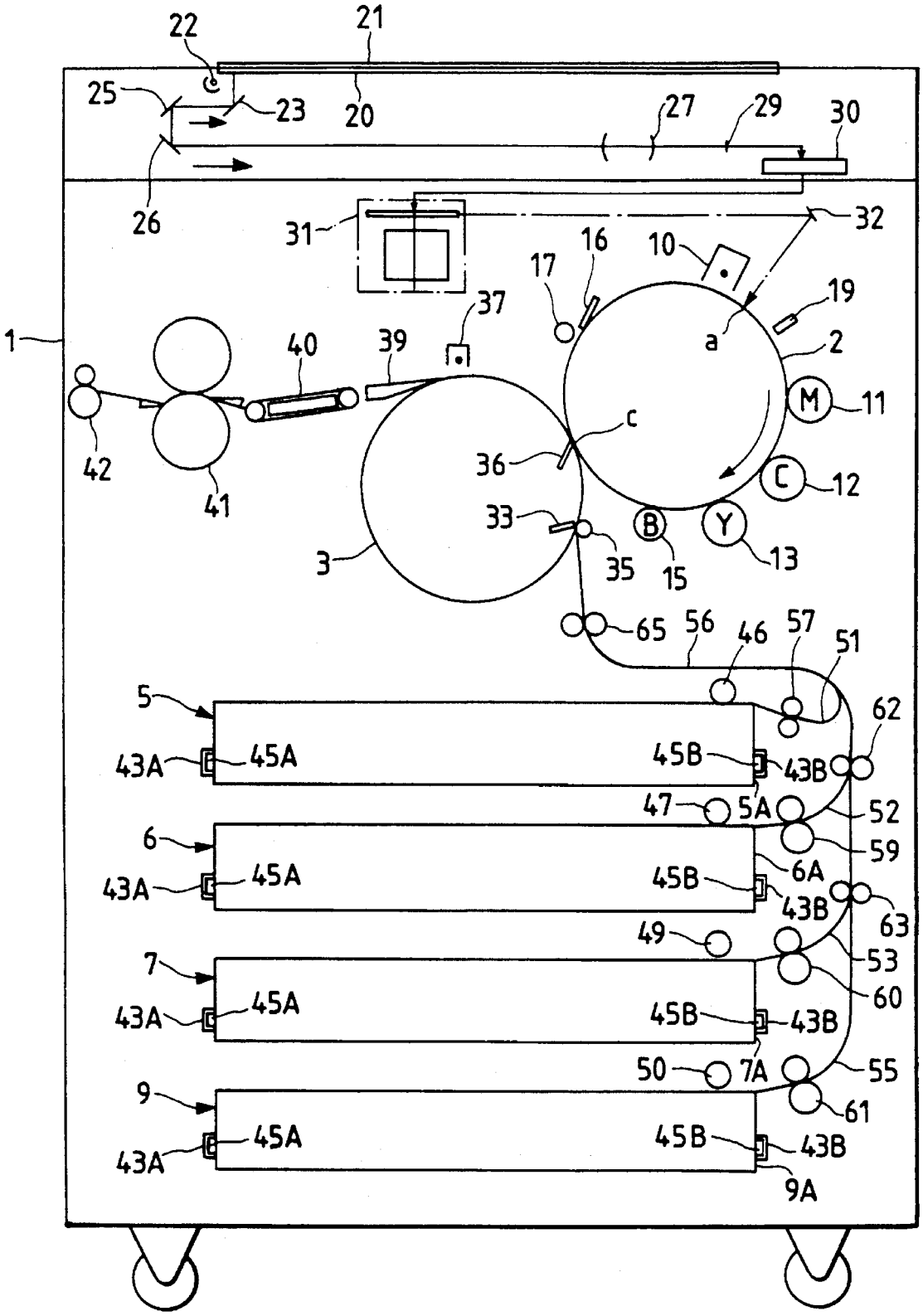
FIG. 6 PRIOR ART
FIG. 6 is a longitudinal sectional view of a conventional color image forming apparatus (copying machine).

Next, a method for feeding the sheet will be explained with reference to FIG. 5.

A sheet $P_2$ fed through between guides 203, 204 is curled to have upward convex while the sheet is being passed between a sponge roller 201 and a lower roller 202. The sheet is further fed to pass between the right guide 205 and the movable guide 207 and between the right guide 205 and the upper guide 215 and to reach the pair of register rollers 216, 217 now stopped. By further feeding the sheet $P_2$ by about 5 mm by rotating the rollers 201, 202, as shown, a loop having downward convex is formed in the sheet $P_2$ while shifting the movable guide to the left around a pivot 206 in opposition to a force of a spring 208 (by the resiliency or rigidity of the sheet itself). Then, the rollers 201, 202 are stopped. A further movement of the sheet $P_2$ is the same as that of the sheet $P_1$ as mentioned above. Incidentally, regarding the sheet $P_1$, since the movable guide 207 can be shifted to the right, a loop having downward convex may be formed in the sheet $P_1$.

Now, the reason why the sheet $P_2$ alone is curled is that, if there is no curl, the sheet $P_2$ tends to be curled in a direction that it is difficult to wind the sheet $P_2$ around the transfer drum while the sheet $P_2$ is being fed through the guides 203, 204, 205 and 207. With this arrangement, since the sheet path for feeding the sheet $P_2$ is sufficiently longer than a length of the sheet $P_2$, it is easy to provide rollers for curling the sheet in the sheet path. In the example shown in FIG. 5, the rollers 201, 202 disposed at an upstream side of the regist rollers 216, 217 serve as the rollers for curling the sheet. However, such roller for curling the sheet may be provided at an upstream side of the feed rollers 201, 202.

To the contrary, since the sheet $P_2$ tends to be curled in a direction that the sheet can easily be wound around the transfer drum, it is no need to provide any rollers for curling the sheet $P_1$ in the sheet path. Accordingly, since the junction between the sheet paths for the sheet $P_1$, $P_2$ can be arranged immediately below and in the vicinity of the adsorption portions 105*c*, 105*g* of the transfer drum 105*a* and the sheet supply cassette 107 can be arranged at the right side of the junction, the height of the apparatus does not increase due to the presence of the sheet supply cassette 107. Further, since the uppermost sheet supply cassette is small-sized to contain small-sized sheets exclusively, the cassette does not interfere with the both-sided vertical sheet path and the width of the apparatus does not increase due to the presence of the sheet supply cassette 107.

What is claimed is:

1. An image forming apparatus, comprising:

first accommodating means for accommodating sheets therein;

second accommodating means arranged above said first accommodating means for accommodating sheets therein;

image forming means arranged above said second accommodating means for forming an image on the sheet, said image forming means including an image bearing member for bearing a toner image to be transferred onto the sheet, and a transfer drum rotating while supporting the sheet for transferring the toner image on said image bearing member onto the sheet;

a first sheet guide path including a first curved portion for guiding the sheet fed out from a first end of said first accommodating means in a predetermined direction to turn it in a direction opposite to the predetermined direction, and a second curved portion for guiding the sheet passed through the first curved portion to turn it upwardly in a direction opposite to a curve of the transfer drum toward said image forming means; and a second sheet guide path including a third curved portion for guiding the sheet fed out from a second end of said second accommodating means in a direction the same as the predetermined direction upwardly toward said image forming means, and being joined to said first sheet guide downstream of the second curved portion; and curl forming means disposed upstream of the second curved portion in a sheet supply direction for forming a curl on the sheet in a direction the same as the curve of the transfer drum.

2. An image forming apparatus according to claim 1, wherein each of said first and second accommodating means comprises a cassette.

3. An image forming apparatus according to claim 2, wherein said cassettes are shiftable in a direction interacting to a sheet feeding direction in a horizontal plane.

4. An image forming apparatus according to claim 1, further comprising feed means for feeding the sheet in a timed relation to the operation timing of said image forming means, said feed means disposed in said first sheet guide path.

5. An image forming apparatus according to claim 1, wherein said image forming means has an image bearing member for bearing a toner image to be transferred onto the sheet.

6. An image forming apparatus according to claim 5, wherein said image forming means has a transfer drum rotating while supporting the sheet for transferring the toner image on said image bearing member onto the sheet.

7. An image forming apparatus according to claim 6, further comprising means for absorbing the sheet to said transfer drum.

8. An image forming apparatus according to claim 7, wherein said image forming means includes color image forming means for forming respective color toner images having different colors on said image bearing member, and the respective color toner images are successively transferred onto the sheet adhered to said transfer drum.

9. An image forming apparatus according to claim 1, wherein a junction portion between said first and second sheet guide paths is disposed between said image forming means, said first end and said second end.

10. An image forming apparatus according to claim 1, wherein said first curved portion includes a U shape curve.

11. An image forming apparatus according to claim 1, wherein a maximum size of the sheet contained in said second accommodating means is smaller than a maximum size of the sheet contained in said first accommodating means.

12. An image forming apparatus according to claim 1, wherein said second and third curved portions are curved in opposite directions to each other.

13. An image forming apparatus, comprising:

first accommodating means for accommodating sheets therein;

second accommodating means arranged above said first accommodating means for accommodating sheets therein;

image forming means arranged above said second accommodating means for forming an image on a sheet, said image forming means including an image bearing member bearing a toner image to be transferred onto the sheet, and a transfer drum rotating while supporting the sheet for transferring the toner image of said image bearing member onto the sheet;

a first sheet guide path including a first curved portion for guiding the sheet fed out from a first end of said first accommodating means in a predetermined direction to turn it in a direction opposite to the predetermined direction, and a second curved portion for guiding the sheet passed through the first curved portion to turn upwardly in a direction opposite a curve of the transfer drum toward said image forming means; and a second sheet guide path including a third guide portion for guiding the sheet fed out from a second end of said second accommodating means in a direction same as the predetermined direction upwardly toward said image forming means, and being joined to a downstream side of the second curved portion of said first sheet guide downstream of the third curved portion;

wherein a first portion of said first sheet guide path between the first curved portion and the second curved portion are positioned at a same height as a second portion of said second sheet guide path between the third curved portion and said second accommodating portion, the sheets advancing guided by the first and second portion to approach each other; and the second curved portion and the third curved portion are curved in the opposite direction; and curl forming means disposed upstream of the second curved portion in a sheet supply direction for forming a curl on the sheet in a direction the same as the curve of the transfer drum.

14. An image forming apparatus according to claim 13, wherein an inlet for said image forming means is disposed above a location where the first sheet guide path and second sheet guide path are joined.

15. An image forming apparatus according to claim 14, wherein, at the inlet for said image forming means, the sheet is supplied upwardly.

16. An image forming apparatus according to claim 13, wherein said image forming means includes an image bearing member for bearing a toner image to be transferred to the sheet, and a transfer drum rotating with supporting the sheet for transferring the toner image of the image bearing member to the sheet, the image bearing member and the transfer drum being arranged side by side.

17. An image forming apparatus according to claim 13, further comprising curl forming means for forming a curl of the same direction for the sheet guided by said first sheet guide means and the sheet guided by said second sheet guide means.

18. An image forming apparatus according to claim 17, wherein said curl forming means curls the sheet in a direction wherein it follows the peripheral surface of said transfer drum.

19. An image forming apparatus according to claim 18, wherein said curl forming means curls the sheet guided by said second sheet guide path.

20. An image forming apparatus according to claim 16, further comprising absorbing means causing the sheet to absorb onto the transfer drum.

21. An image forming apparatus according to claim 20, wherein said image forming means has means for forming toner images of plural different colors on said image bearing member, said transfer drum transferring the toner image of each color sequentially onto the sheet absorbed onto the transfer drum.

22. An image forming apparatus according to claim 13, wherein said joined portion of the first and second sheet guide path is located among said image forming means, and said first end and said second end.

23. An image forming apparatus according to claim 13, wherein said second accommodating means is of a larger capacity than said first accommodating means.

24. An image forming apparatus according to claim 13, wherein, below said second accommodating means, at least one accommodating means for accommodating the sheet therein is provided.

25. An image forming apparatus, comprising:

image forming means for forming an image on a sheet, said image forming means including an image bearing member for bearing a toner image to be transferred onto the sheet, and a transfer drum rotating while supporting the sheet for transferring the toner image of said image bearing member onto the sheet;

a guide path including a curved portion for guiding the sheet with curving it in a direction opposite to a curve of the transfer drum; and curl forming means disposed upstream of said guide path in a supply direction for forming a curl on the sheet in a direction the same as the curve of the transfer drum.

26. An image forming apparatus according to claim 25, further comprising guide means for guiding the sheet while bending it in direction opposite to the peripheral surface of the transfer drum.

27. An image forming apparatus, according to claim 26, further comprising accommodating means for accommodating the sheet therein, which sheet is supplied by said sheet supplying means.

28. An image forming apparatus according to claim 27, wherein said accommodating means is disposed below said image forming means.

29. An image forming apparatus according to claim 25, wherein said curl forming means has a guide for guiding the sheet, the curl being formed by guiding the sheet under conditions where the sheet is bent upwardly.

* * * * *

UNITED STATES PATENT AND TRADEMARK OFFICE

CERTIFICATE OF CORRECTION

PATENT NO. : 5,565,970

DATED : October 15, 1996

INVENTOR(S) : Suda

It is certified that error appears in the above-indentified patent and that said Letters Patent is hereby corrected as shown below:

Title page, item [54], and col. 1, line 1,

Change "IMAGE FORMING APPARATUS" to --IMAGE FORMING APPARATUS WITH PLURAL SHEET GUIDE PATHS AND SHEETS OF UNIFORM CURLING ORIENTATION--.

COLUMN 1

Line 50, change "a" to --an--;

Line 54, change "an" to --a--.

COLUMN 2

Line 48, change "path" to --paths--.

COLUMN 3

Line 2, delete ".";

Line 20, change "are" to --is--.

COLUMN 4

Line 18, change ". Wherein " to -- wherein --.

COLUMN 6

Line 3, delete "can be used".

COLUMN 7

Line 6, change "sheet" to --film--;

Line 9, change "sheet" to --film--; (2nd occur.)

Line 34, change "sheet" to --film--;

Line 36, change "sheet" to --film--; (2nd occur.)

UNITED STATES PATENT AND TRADEMARK OFFICE

CERTIFICATE OF CORRECTION

PATENT NO. : 5,565,970

DATED : October 15, 1996

INVENTOR(S) : Suda

It is certified that error appears in the above-indentified patent and that said Letters Patent is hereby corrected as shown below:

COLUMN 7 (cont'd)

Line 39, change "sheet" to --film--;
Line 46, change "sheet" to --film--;
Line 50, change "path" to --paths--;
Line 64, delete "in";
Line 65, change "sheet" to --film--; (2nd occur.)
Line 66, change "regist" to --register--.

COLUMN 8

Line 40, change "regist" to --register--.

COLUMN 9

Line 29, change "interacting" to --intersecting--.

Signed and Sealed this

Twenty-fifth Day of March, 1997

*Attest:*

Bruce Lehman

BRUCE LEHMAN

*Attesting Officer*

*Commissioner of Patents and Trademarks*